US006585007B2

(12) United States Patent
Kubokawa

(10) Patent No.: US 6,585,007 B2
(45) Date of Patent: Jul. 1, 2003

(54) METHOD FOR FILLING LIQUID INTO LIQUID CONTAINER AND APPARATUS ADAPTED TO USE SUCH METHOD

(75) Inventor: Toru Kubokawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/061,252

(22) Filed: Feb. 4, 2002

(65) Prior Publication Data

US 2002/0104578 A1 Aug. 8, 2002

(30) Foreign Application Priority Data

Feb. 7, 2001 (JP) ..... 2001-030431

(51) Int. Cl.[7] ..... B65B 1/04
(52) U.S. Cl. ..... 141/39; 141/65; 141/59
(58) Field of Search ..... 141/2, 18, 39, 141/65, 59, 106, 364; 347/85–87

(56) References Cited

U.S. PATENT DOCUMENTS 4,452,377 A * 6/1984 Hurley et al. ..... 222/1
4,860,804 A * 8/1989 Yamaguchi et al. ..... 141/94
5,433,238 A * 7/1995 Cannizzaro et al. ..... 137/14
6,199,600 B1 * 3/2001 Ahn et al. ..... 141/2

* cited by examiner

*Primary Examiner*—Steven O. Douglas
(74) *Attorney, Agent, or Firm*—Fitzpatrick, Cella, Harper & Scinto

(57) ABSTRACT

Refilling of a used liquid container of a liquid ejector such as an ink-jet apparatus is carried out by sequentially performing the steps of drawing out liquid remaining in the liquid container by way of a liquid outlet port of the liquid container, reducing the inner pressure of the evacuated liquid container by way of the liquid outlet port, and filling liquid from a liquid supply tank into the liquid container by way of the liquid outlet port. The liquid drawn out from the liquid container is fed back into the liquid supply tank.

12 Claims, 3 Drawing Sheets

METHOD FOR FILLING LIQUID INTO LIQUID CONTAINER AND APPARATUS ADAPTED TO USE SUCH METHOD

BACKGROUND OF THE INVENTION

1. Field of the Invention

This invention relates to a method for filling liquid into a liquid container and also to an apparatus adapted to use such a method. More particularly, the present invention relates to a liquid filling method and a liquid filling apparatus for filling liquid into an ejection type liquid container adapted to contain liquid such as ink to be used in a liquid ejector.

2. Related Background Art

A liquid ejector (ink-jet apparatus) comprises a liquid ejection head for ejecting liquid such as ink and recording images such as characters and graphics and a liquid tank operating as liquid container for storing liquid such as ink to be fed to the liquid ejection head. Normally, the liquid tank has a structure adapted to be removably fitted to the liquid ejector so that it may be replaceable at any time. When a liquid tank that can be separated from the liquid ejection head is used and all the liquid in the liquid tank is consumed to make the tank empty so that the liquid ejector can no longer operate for recording images, the liquid tank is replaced by a new one filled with liquid so that the image recording operation can be resumed. On the other hand, in the case of a liquid ejector comprising a liquid tank and a liquid ejection head that are formed integrally relative to each other, the liquid ejection head needs to be replaced by new one when all the liquid in the liquid tank is consumed, regardless of the service life of the liquid ejection head. Therefore, the use of a liquid tank that is separable from the liquid ejection head is advantageous in terms of running cost if compared with a liquid tank of the integral type. Additionally, precious resources will be saved to a great advantage of environment protection if the emptied liquid tank is filled with liquid again for reuse.

Particularly, the use of separate type liquid tanks is desired for so-called mobile type printers that are compact and portable because such printers require the use of a compact liquid tank whose size and liquid containing capacity are made very small, reflecting the small size of the printer main body, and the liquid contained in the liquid tank can be used up quickly if compared with a stationary type printer that may be used on the top of a desk so that the liquid tank needs to be refilled frequently.

Various methods and devices have been proposed for refilling liquid into such a liquid tank. For instance, there are known methods with which liquid is filled into a liquid tank under pressure through an air inlet port or a refilling port bored through the wall of the tank. Refill kits to be used for manual refilling operations are also known and commercially available. With other known methods, the inner pressure of a liquid tank is reduced so that liquid may be filled into it conveniently. Such methods are popularly being used for filling liquid into mint liquid tanks.

However, methods for manually refilling a liquid tank that may contain residual liquid to some extent are accompanied by the following problems. Firstly, the effect of manual refilling operation is heavily dependent on the skill of the operator and the liquid tank may not be sufficiently refilled. More specifically, the operator is required to manually refill the liquid tank while applying pressure to the liquid to be filled into the liquid tank. As a matter of fact, the operator more often than not applies excessive pressure to the liquid.

Then, the ink supply rate exceeds the rate at which liquid permeates the absorbent member in the liquid tank. The net result is that liquid is not filled into the inside of the liquid tank properly but overflows from the tank. Secondly, the operator is totally occupied by the liquid refilling operation and can not do any other operation because pressure needs to be applied in a well controlled manner as a function of the amount of liquid currently existent in the liquid tank. The refilling operation normally takes a long time. Again, the time required for the refilling operation can vary depending on the skill of the operator.

Automatic refilling devices have also been proposed in order to bypass the above problems and other problems of manual refilling operation. However, known automatic refilling devices have a complicated structure mainly because the pressure applied to the liquid to be filled into the liquid tank and the rate at which liquid is fed into the tank need to be controlled by sensing the internal condition of the liquid tank.

Some methods for refilling liquid into a liquid tank under pressure are designed to utilizes a refilling port. However, the liquid flow path of a liquid tank is formed in such a way that all the liquid contained in the liquid tank eventually comes to the liquid outlet port of the tank. In other words, the provision of a refilling port means that the liquid tank has a liquid flow path in the inside that is totally unrelated to the proper use of the liquid tank. Such an additional flow path can bias the liquid in the liquid tank and interfere with a smooth movement of liquid toward the liquid outlet port. Then, the liquid tank will operate unsatisfactorily.

On the other hand, known methods for refilling a liquid tank with liquid while reducing the internal pressure of the tank are mostly designed to fill liquid into mint liquid tanks. If such methods are applied to a liquid refilling operation, the refilling operation needs to be controlled as a function of the amount of residual liquid. Then, the refilling device to be used with such a method needs to be provided with means for detecting the amount of residual liquid and means for changing the extent of pressure reduction as a function of the amount of residual liquid to make the device very complicated one.

SUMMARY OF THE INVENTION

In view of the above identified problems of the prior art, it is therefore the object of the present invention to provide a liquid filling method and a liquid filling apparatus that can accurately refill liquid into a liquid container to be used with a liquid ejector regardless of the amount of liquid remaining in the container without requiring any complex control operation and other refilling arrangement.

In an aspect of the invention, the above object is achieved by providing a liquid filling method for filling liquid into a liquid container of the type having a porous liquid absorbent member arranged in the inside and adapted to hold liquid under negative pressure generated in the inside and communicating to a liquid ejection head so as to supply liquid from the inside to the liquid ejection head by way of a liquid outlet port, the method comprising:

- a step of drawing out liquid remaining in the liquid container by way of the liquid outlet port;
- a step of reducing the inner pressure of the evacuated liquid container by way of the liquid outlet port; and
- a step of filling liquid from the inside of a liquid supply tank into the liquid container by way of the liquid outlet port.

Preferably, with the liquid filling method for filling liquid into a liquid container according to the invention, the liquid drawn out from the liquid container is fed back into the liquid supply tank.

Preferably, when drawing out the liquid remaining in the liquid container with the liquid filling method for filling liquid into a liquid container according to the invention, the time to be used for the step of drawing out the liquid remaining in the liquid container is determined on the basis of the relationship between the maximum liquid containing capacity of the liquid container and the means to be used for drawing out liquid and the liquid remaining in the liquid container is drawn out in a determined constant operation time regardless of the amount of liquid remaining in the liquid container. Preferably, when reducing the internal pressure of the liquid container with the liquid filling method for filling liquid into a liquid container according to the invention, the time to be used for the step of reducing the internal pressure of the liquid container is determined on the basis of the relationship between the maximum volume of gas containable in the inside of the totally evacuated liquid container and the means to be used for reducing the internal pressure of the liquid container and the internal pressure of the liquid container is reduced in a predetermined constant operation time.

In another aspect of the present invention, there is provided a liquid filling apparatus for filling liquid into a liquid container communicating to a liquid ejection head so as to supply liquid from the inside to the liquid ejection head by way of a liquid outlet port, said apparatus comprising:

- a liquid drawing out means for drawing out the liquid remaining in the liquid container by way of the liquid outlet port;
- a pressure reducing means for reducing the inner pressure of the evacuated liquid container by way of the liquid outlet port;
- a liquid supply tank for storing liquid to fill the liquid container; and
- a filling means for filling liquid from the inside of the liquid supply tank into the liquid container by way of the liquid outlet port.

Preferably, a liquid filling apparatus according to the invention further comprises a liquid feeding back means for feeding the liquid drawn out from the liquid container by the liquid drawing out means back into the liquid supply tank.

Preferably, a liquid filling apparatus according to the invention further comprises a collection tank for temporarily holding the liquid drawn out from the liquid container by the liquid drawing out means. Preferably, the capacity of the collection tank is substantially equal to the capacity of a liquid container that is largest among liquid containers expected to be refilled with liquid by the liquid filling apparatus. Preferably, the bottom surface of the collection tank is located above the liquid supply tank.

Preferably, in a liquid filling apparatus according to the invention, the liquid drawing out means is provided with a suction pump or piston cylinder mechanism and the drive time of the suction pump or piston cylinder mechanism is determined on the basis of the relationship between the performance of the suction pump or piston cylinder mechanism and the maximum liquid containing capacity of the liquid container so as to drive the suction pump or piston cylinder mechanism and draw out the liquid remaining in the liquid container for a determined constant operation time regardless of the amount of liquid remaining in the liquid container. Preferably, in a liquid filling apparatus according to the invention, the pressure reducing means is provided with a suction pump or piston cylinder mechanism and the drive time of the pressure reducing means is determined on the basis of the relationship between the performance of the suction pump or piston cylinder mechanism and the maximum volume of gas containable in the inside of the totally evacuated liquid container so as to drive the suction pump or piston cylinder mechanism and reduce the internal pressure of the liquid container for a determined constant operation time. Preferably, the liquid drawing out means and the pressure reducing means are commonly provided with a suction pump or piston cylinder mechanism.

Thus, according to the invention, with a liquid container of the type having a porous liquid absorbent member arranged in the inside and adapted to hold liquid under negative pressure generated in the inside and communicating to a liquid ejection head so as to supply liquid from the inside to the liquid ejection head by way of a liquid outlet port, the liquid remaining in the liquid container is drawn out by way of the liquid outlet port, the inner pressure of the liquid container is reduced by way of the liquid outlet port and liquid is refilled from the inside of a liquid supply tank into the liquid container by way of the liquid outlet port. With this arrangement, it is now possible to accurately refill the liquid container regardless of the amount of liquid remaining in the liquid container without requiring any complex control procedure and complex device. Because only the liquid outlet port is used for drawing out liquid from and filling liquid into the liquid container in the liquid refilling operation, any possible degradation of the performance of the liquid container due to the provision of a liquid flow path not directed to the liquid outlet port is effectively avoided. Additionally, the operator is not required to have a specific skill for the liquid refilling operation nor occupied by the operation for a long period of time.

DESCRIPTION OF THE PREFERRED EMBODIMENTS

Now, the present invention will be described by referring to the accompanying drawings that illustrate preferred embodiments of the invention.

Embodiment 1

Figure 2:
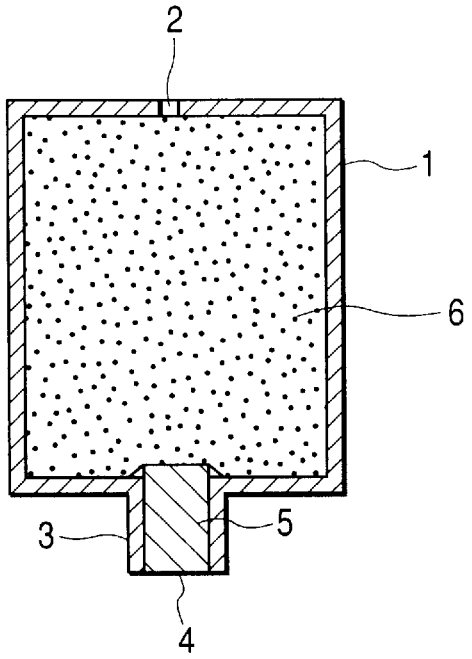
FIG. 2 is a schematic cross sectional view of a liquid tank that can be used with a liquid filling method according to the invention.

Referring to FIG. 2, liquid tank 1 or liquid container is adapted to be used with this embodiment and mounted in a liquid ejector. As seen from FIG. 2, it has a substantially rectangularly parallelepipedic profile and is provided at the top thereof with an atmosphere exposure port 2 that allows the inside of the liquid tank to communicate to the atmosphere and at the bottom thereof with a liquid supply pipe 3 that has a cylindrical profile and is projecting downward from the liquid tank 1. The liquid supply pipe 3 is provided at the lower end thereof with a liquid outlet port 4. A press fit member 5 is inserted into the liquid supply pipe 3. The inside of the liquid tank 1 is filled with a porous absorbent member 6 typically made of urethane foam. The absorbent member 6 communicates to the atmosphere by way of the atmosphere exposure port 2 at the top of the liquid tank 1 and with the liquid outlet port 4 arranged at the bottom of the liquid tank 1. Additionally, the absorbent member 6 is adapted to generate negative pressure in the inside of the liquid tank 1 to absorb and hold liquid such as ink there. The liquid tank 1 having the above described configuration is mounted in a liquid ejector so as to communicate to a liquid ejection head (not shown) and supply liquid from the porous absorbent member 6, which is adapted to generate negative pressure for liquid, to the liquid ejection head by way of the liquid outlet port 4 of the liquid supply pipe 3.

Now, a liquid filling apparatus for refilling liquid into such a liquid tank will be described by referring to FIG. 1.

Figure 1:
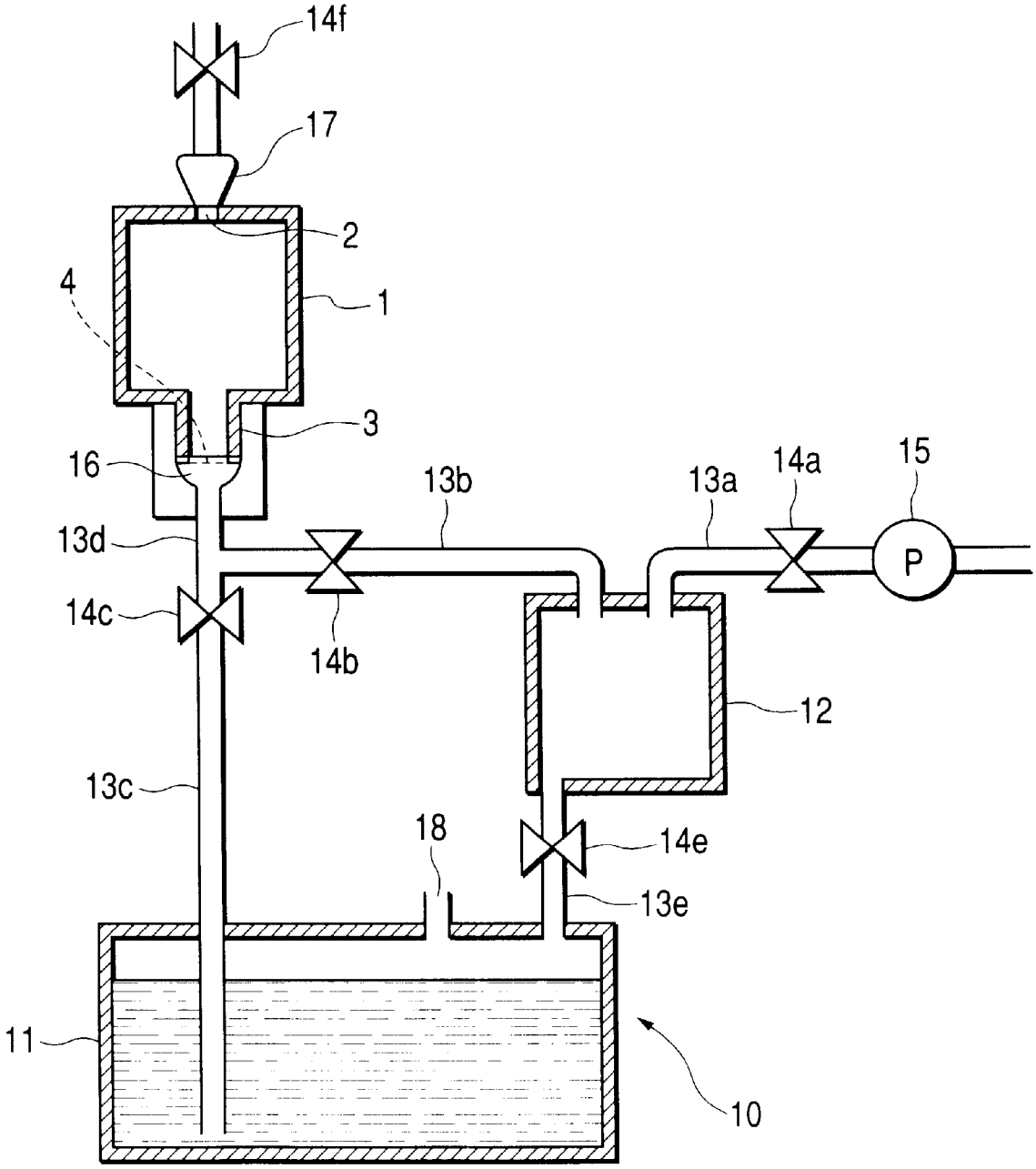
FIG. 1 is a schematic illustration of an embodiment of liquid filling apparatus according to the invention and adapted to refill liquid into a liquid tank by a liquid filling method according to the invention.

As shown in FIG. 1, this embodiment of liquid filling apparatus 10 comprises a liquid supply tank 11 for containing liquid such as ink to be used as refill and a collection tank 12 for holding the liquid such as ink drawn out and collected from a liquid tank 1 to be refilled. A tank pressure reduction pipe 13*a* having a refill changeover valve 14*a* and a collection pipe 13*b* having a collection valve 14*b* are separately connected to the collection tank 12. The tank pressure reduction pipe 13*a* is connected to a pump 15. The liquid supply tank 11 is provided at the top thereof with an atmosphere exposure port 18 and connected to a liquid supply pipe 13*c* for transferring liquid from the inside of the liquid supply tank 11 into the liquid tank 1. The liquid supply pipe 13*c* has a refilling valve 14*c*. The liquid supply pipe 13*c* is connected to a liquid incoming/outgoing pipe 13*d* having a liquid inlet/outlet port 16 at an end thereof. The liquid inlet/outlet port 16 is adapted to be connected to the liquid supply pipe 3 of the liquid tank 1 having a liquid outlet port 4 at the front end thereof. Therefore, the inner diameter of the liquid inlet/outlet port 16 is made to be substantially equal to the outer diameter of the liquid outlet port 4 of the liquid tank 1 so that the liquid supply pipe 3 of the liquid tank 1 may be inserted into the liquid inlet/outlet port 16 of the liquid incoming/outgoing pipe 13*d*. The collection pipe 13*b* is also connected to the liquid incoming/outgoing pipe 13*d*. As for the positional relationship of the liquid supply tank 11 and the collection tank 12, the bottom of the collection tank 12 is so arranged as to be located above the top surface of the liquid supply tank 11. Additionally, the liquid supply tank 11 and the collection tank 12 are linked to each other by way of a collected liquid feeding back pipe 13*e* having a feedback valve 14*e* so that the residual ink in the liquid tank 1 is collected and temporarily stored in the collection tank 12 and then may be returned to the liquid supply tank 11 by utilizing the difference of height between the two tanks 11 and 12. A cap 17 adapted to cover the atmosphere exposure port 2 of the liquid tank 1 is arranged above the liquid inlet/outlet port 16. The cap 17 is provided with an atmosphere exposure valve 14*f*.

The pump 15 is made to communicate to the inside of the liquid tank 1 by way of the tank pressure reduction pipe 13*a*, the collection tank 12, the collection pipe 13*b*, the liquid incoming/outgoing pipe 13*d* and the liquid inlet/outlet port 16 as the refill changeover valve 14*a* and the collection valve 14*b* are opened. Therefore, the liquid remaining in the liquid tank 1 can be sucked and drawn out by driving the pump 15 under this condition. Additionally, the internal pressure of the liquid tank 1 can be reduced by driving the pump 15 when the pump 15 is made to communicate to the inside of the liquid tank 1 and the atmosphere exposure port 2 of the liquid tank 1 is closed by the cap 17 to give rise to an airtight condition there. As the liquid supply tank 11 and the liquid tank 1 are made to communicate to each other by way of the liquid supply pipe 13*c* by closing the collection valve 14*b* and opening the refilling valve 14*c* after reducing the internal pressure of the liquid tank 1, the liquid tank 1 can be supplied with liquid from the inside of the liquid supply tank 11 by utilizing the pressure difference between the liquid supply tank 11 and the liquid tank 1.

While FIG. 1 only schematically illustrates the configuration of the liquid filling apparatus and the means for driving the pump 15, the means for opening/closing the valves 14 (14*a* through 14*f*), the means for controlling them and the means for executing the program for the refilling operation are not shown, although the liquid filling apparatus comprises all these means.

The liquid refilling apparatus 10 shown in FIG. 1 is described above so as to be used with a single liquid tank. However, for instance, it may alternatively be provided with four independent sets of liquid supply tanks 11, collection tanks 12, pipes 13 (13*a* through 13*d*) and valves 14 (14*a* through 14*f*) for closing the respective liquid flow paths for a liquid ejector (ink-jet printer) that is adapted to use four different liquids such as inks of four different colors including black, cyan, magenta and yellow. With this arrangement, the single pump 15 is commonly used for the liquid refilling tanks 11 and the tank pressure reduction pipes 13*a* that communicate to the pump 15 are provided with respective refill changeover valves 14*a*. Then, the inks in the liquid containers may be used for refilling sequentially by switching from one refill changeover valve 14*a* to another.

Now, a liquid refilling operation of this embodiment of liquid filling apparatus will be described below.

In the initial state of the liquid filling apparatus 10, the liquid refill changeover valve 14*a* of the tank pressure reduction pipe 13*a* is closed and the collection valve 14*b* of the collection pipe 13*b* is open, while the feed back valve 14*e* of the collected liquid feeding back pipe 13*e* is closed.

Then, firstly, the liquid tank 1 to be refilled with liquid is put into the liquid filling apparatus 10 and the liquid outlet port 4 of the liquid tank 1 is inserted into the liquid inlet/outlet port 16 of the liquid incoming/outgoing pipe 13*d*. The pressure generated when the liquid supply pipe 3 is pushed into the liquid inlet/outlet port 16, or the excessive air existing there, is released to the collection tank 12 by way of the liquid incoming/outgoing pipe 13*d* and the collection pipe 13*b*. Preferably, the liquid outlet port 4 and the liquid inlet/outlet port 16 of the liquid incoming/outgoing pipe 13*d* are provided with respective color labels showing the color of the liquid in the liquid tank 1 in order to avoid mistaking the type and color of the ink.

After the liquid tank 1 is set in position relative to the liquid inlet/outlet port 16 of the liquid incoming/outgoing pipe 13*d*, the liquid refill changeover valve 14*a* of the tank pressure reduction pipe 13*a* is opened. Subsequently, the pump 15 is driven to reduce the pressure in the flow path from the liquid inlet/outlet port 16 to the pump 15 (formed by the liquid incoming/outgoing pipe 13*d*, the collection pipe 13*b*, the collection tank 12 and the tank pressure reduction pipe 13*a*) to a level lower than the negative pressure in the liquid tank 1 for holding liquid there. As a result, the liquid remaining in the liquid tank 1 is drawn out through the liquid outlet port 4. The liquid drawn out from the liquid outlet port 4 of the liquid tank 1 by way of the liquid inlet/outlet port 16 is made to pass through the collection pipe 13*b* and temporarily stored in the collection tank 12 before it gets to the pump 15. Note that that collection tank 12 is made to have a capacity substantially equal to the capacity of the liquid container that is largest among the liquid containers expected to be refilled with liquid. It may be suffice for the collection tank 12 to have a capacity as large as possible in order to prevent the collected liquid from overflowing and going into the tank pressure reduction pipe 13*a*. However, the capacity of the collection tank 12 is defined in a manner as described above because it takes a long time to reduce the pressure in the liquid flow path including the collection tank 12 for the purpose of drawing out the residual liquid if the collection tank 12 has an excessively large capacity. It may be needless to say that the time required for reducing the pressure is preferably as short as possible.

The time required for collecting the residual liquid from the liquid tank 1 is the sum of the time necessary for removing the gas in the collection tank 12 and the flow path between the liquid inlet/outlet port 16 to the pump 15 and the time necessary for drawing out all the liquid in the liquid tank 1 that is full of liquid. The time that may be required for collecting the liquid from the liquid tank 1 is estimated on the basis of the type of the liquid tank and the performance of the pump to be used for the refilling operation and a time period sufficient for drawing out the liquid of the liquid tank having the largest capacity among the liquid tanks that are expected to be refilled with liquid is selected so that the pump 15 is driven for this time period. With this method, while each operation of refilling a liquid tank takes a constant time period regardless of the type of the liquid tank and the amount of liquid remaining in the liquid tank, the liquid filling apparatus 10 can be made to have a simple configuration if compared with known liquid filling apparatus to be used with a method which includes changing the time period for which the pump is driven depending on the amount of the residual liquid because the latter method requires the use of a means for detecting the amount of the residual liquid. Additionally, it is possible to estimate the time required for drawing out all the liquid in a liquid tank filled with liquid of each of the types that are expected to be used for refilling operations and store it in a memory. Then, an optimal time period may be selected for drawing out the residual liquid from each liquid tank to be refilled depending on the type of the liquid tank and reduce the time required for the overall liquid drawing operations.

When the predetermined time selected for the liquid tank has elapsed since the start of driving the pump 15, the operation of the pump 15 is temporarily suspended and the atmosphere exposure port 2 of the liquid tank 1 is closed to an airtight condition. The cap 17 is provided with an atmosphere exposure valve 14*f* for exposing the air flow path between the top of the liquid tank 1 where the atmosphere exposure port 2 is provided with the cap 17. For closing the liquid tank 1 to an airtight condition, the atmosphere exposure valve 14*f* is opened temporarily and then closed again after closing the atmosphere exposure port 2 by means of the cap 17.

When the atmosphere exposure port 2 of the liquid tank 1 is closed and held in an airtight condition, the pump 15 is driven once again to reduce the internal pressure of the liquid tank 1. As in the case of drawing out the residual liquid, the time that may be required for reducing the internal pressure of the liquid tank 1 is estimated on the basis of the type of the liquid tank to be refilled and the performance of the pump to be used for the pressure reducing operation and a time period sufficient for reducing the internal gas pressure of the liquid tank when the latter contains no liquid is selected so that the pump 15 is driven for this time period. It is also possible to estimate the time required for reducing the internal pressure of a liquid tank containing no liquid of each of the types that are expected to be used for gas pressure reducing operations and store it in a memory. Then, an optimal time period may be selected for reducing the internal gas pressure of each liquid tank to be refilled depending on the type of the liquid tank and reduce the time required for the overall internal gas pressure reducing operations. When the pump 15 is driven for the predetermined time period for reducing the internal pressure, the collection valve 14*b* of the collection pipe 13*b* is closed and the operation of the pump 15 is stopped.

Subsequently, as the refilling valve 14*c* of the liquid supply pipe 13*c* is opened, liquid flows out from the liquid supply tank 11 into the liquid tank 1 by way of the liquid supply pipe 13*c*, the liquid incoming/outgoing pipe 13*d*, the liquid inlet/outlet port 16 and the liquid outlet port 4 of the liquid tank 1 because the atmospheric pressure is applied to the liquid supply tank 11 through the atmosphere exposure port 18 of the liquid supply tank provided at the top thereof while pressure lower than the atmospheric pressure is applied to the inside of the liquid tank 1.

When the liquid refilling operation is over, the refilling valve 14*c* is closed and the atmosphere exposure valve 14*f* connected to the cap 17 is opened. Then, the cap 17 is removed from the liquid tank 1.

On the other hand, the collected liquid that is temporarily stored in the collection tank 12 is fed, back to the liquid supply tank 11 by way of the collected liquid feeding back pipe 13*e* as the feedback valve 14*e* is opened. At this time, the collected liquid in the collection tank 12 is forced to flow into the liquid supply tank 11 simply by opening the feedback valve 14*e* provided that the inside of the collection tank 12 and that of the liquid supply tank 11 are exposed to the atmosphere and the surface of the liquid in the collection tank 12 is located above the surface of the liquid in the liquid supply tank 11 while the collected liquid feeding back pipe 13*e* is connected to the bottom of the collection tank 12 and the top of the liquid supply tank 11.

Figure 3:
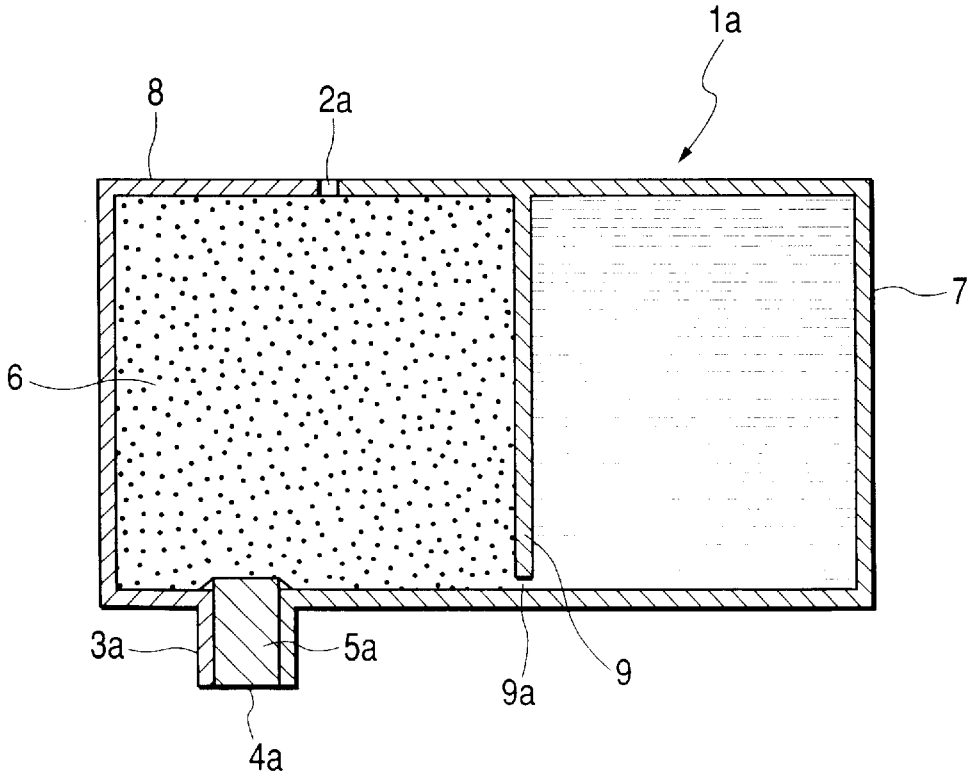
FIG. 3 is a schematic cross sectional view of a liquid tank of the type having a negative pressure generating member containing chamber and a liquid containing chamber that can be used with a liquid filling method according to the invention.

While a liquid tank 1 containing in the inside only an absorbent member 6 as shown in FIG. 2 is selected in this embodiment as liquid tank to be refilled. It may be replaced by a liquid tank 1*a* as shown in FIG. 3 that has a liquid containing chamber 7 and a negative pressure generating member containing chamber 8 containing an absorbent member 6 therein, which chambers are separated from each other by means of a partition wall 9 and communicate to each other only by way of a narrow liquid communicating hole 9*a* arranged near the bottom of the liquid tank. Additionally, the embodiment of liquid filling apparatus may be used with liquid tanks having different capacities so long as a same type of liquid is used for refilling the liquid tanks while the outer diameters of the liquid outlet ports 4, 4*a* of the liquid tanks are same with each other and the atmosphere exposure ports 2, 2*a* can be closed by a cap 17 to an airtight condition because, as pointed out above, the time period for which the pump needs to be driven for each of the liquid tanks may be estimated and stored in a memory so that an optimal time period may be selected for driving the pump for the refilling operation.

Additionally, when a number of liquid tanks are to be refilled and all the liquid tanks have a same capacity, they may be refilled with liquid in a single process if all the refill changeover valves 14*a* arranged on the midway of the respective tank pressure reduction pipes 13*a* are opened or the entire filling system is configured without any refill changeover valve.

Embodiment 2

Figure 4:
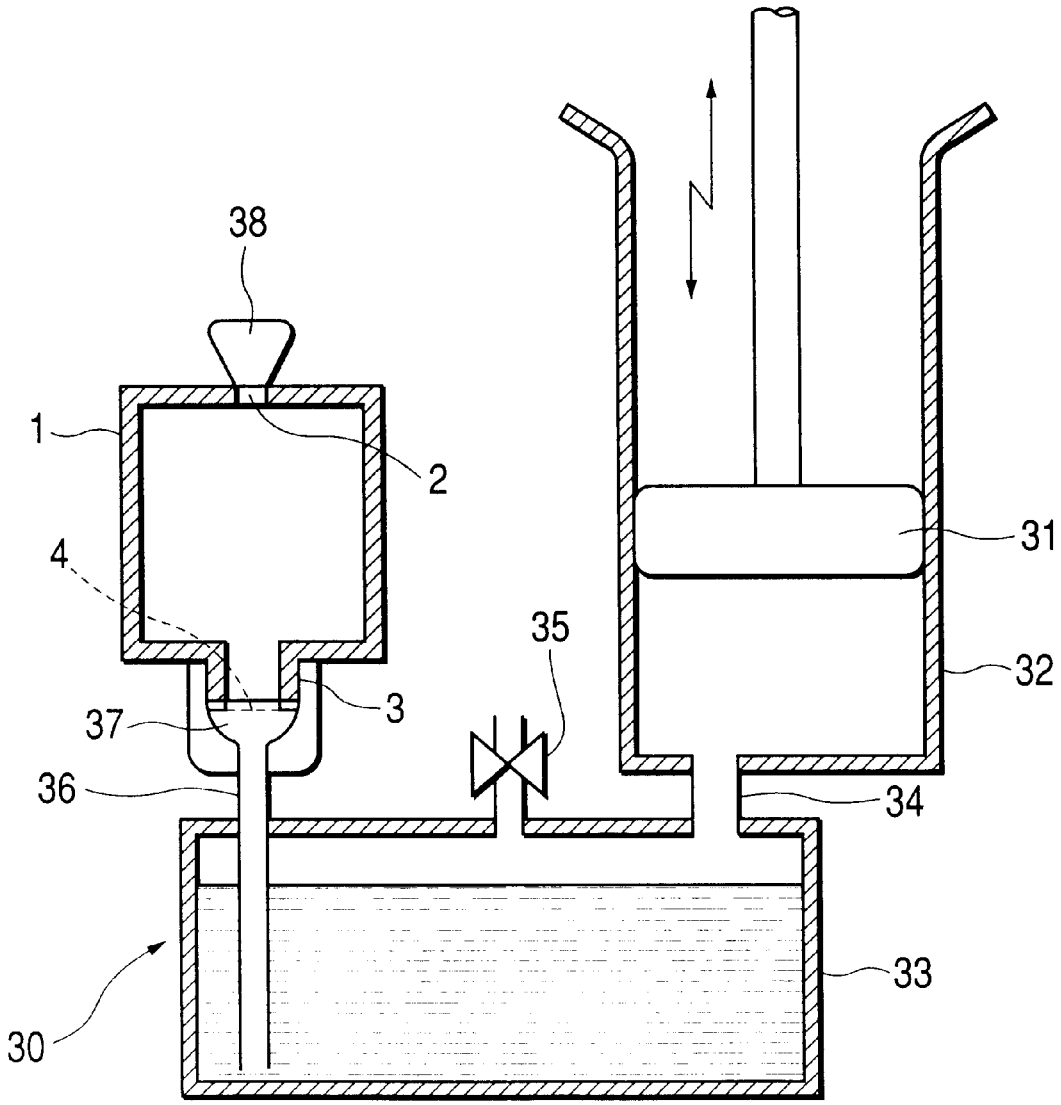
FIG. 4 is a schematic illustration of another embodiment of liquid filling apparatus according to the invention and adapted to refill liquid into a liquid tank by a liquid filling method according to the invention.

FIG. 4 is a schematic illustration of another embodiment of liquid filling apparatus according to the invention and adapted to refill liquid into a liquid tank by a liquid filling method according to the invention.

This embodiment of liquid filling apparatus differs from the first embodiment in that a piston 31 and a cylinder 32 are used to draw out the liquid remaining in the liquid tank that is to be refilled and reducing the internal pressure of the liquid tank.

As shown in FIG. 4, the liquid filling apparatus 30 of this embodiment comprises a cylinder 32 provided with a piston 31 and a liquid supply tank 33 for containing liquid such as ink to be used for refilling operations, of which the liquid supply tank 33 is made to communicate to the bottom of the cylinder 32 by way of a communication pipe 34 arranged at the top thereof. The cylinder 32 has a maximum capacity sufficiently large if compared with the maximum capacity of any of the liquid tanks that may be refilled with liquid by means of this embodiment. The liquid supply tank 33 is provided at the top thereof with an atmosphere exposure valve 35 and connected to a liquid incoming/outgoing pipe 36 for transferring liquid from the inside of the liquid supply tank 33 into the liquid tank 1, the liquid incoming/outgoing pipe 36 being provided at the top thereof with a liquid inlet/outlet port 37 that can be connected to the liquid supply pipe 3 arranged at the bottom of the liquid tank 1 and provided with a liquid outlet port 4. The inner diameter of the liquid inlet/outlet port 37 is made to be substantially equal to the outer diameter of the liquid outlet port 4 of the liquid tank 1 so that the liquid supply pipe 3 of the liquid tank 1 may be inserted into the liquid inlet/outlet port 37 of the liquid incoming/outgoing pipe 36. A cap 38 adapted to cover the atmosphere exposure port 2 of the liquid tank 1 is arranged above the liquid inlet/outlet port 37.

Now, the steps of a liquid refilling operation of this embodiment of liquid filling apparatus will be sequentially described below.

In the initial state of the liquid filling apparatus of this embodiment, the piston 31 is located on the bottom of the cylinder 32 and the atmosphere exposure valve 35 located above the liquid supply tank 33 is opened.

Then, firstly, the liquid tank 1 to be refilled with liquid is put into the liquid filling apparatus 30 and the liquid outlet port 4 of the liquid tank 1 is inserted into the liquid inlet/outlet port 37 of the liquid incoming/outgoing pipe 36. After the liquid tank 1 is set in position, the atmosphere exposure valve 35 of the liquid supply tank 33 is closed.

Subsequently, as the piston 31 is moved upward, the internal pressure of the cylinder 32 in the region located under the piston 31 and on the liquid inlet/outlet port 37 (and hence the pressure in the inside of the liquid supply tank 33 and the liquid incoming/outgoing pipe 36 communicating to the lower region of the cylinder 32) is reduced relative to the negative pressure in the liquid tank 1 for constantly holding liquid there so that the liquid remaining in the liquid tank 1 is drawn out through the liquid outlet port 4 of the liquid tank 1 and sucked into the liquid supply tank 33 by way of the liquid inlet/outlet port 37 and the liquid incoming/outgoing pipe 36. At this time, the piston 31 is moved upward by a distance sufficient for drawing out the liquid in the inside of the liquid tank 1. As all the liquid in the liquid tank 1 is drawn out, the movement of the piston 31 is stopped and the atmosphere exposure valve 35 above the liquid supply tank 33 is opened. Subsequently, the piston 31 is moved back to the bottom of the cylinder 32. Then, the atmosphere exposure port 2 of the liquid tank 1 is closed with the cap 38 to an airtight condition and thereafter the atmosphere exposure valve 35 is closed once again.

As the piston 31 is moved upward once again, the internal pressure of the liquid tank 1 is reduced. Note that the piston 31 is moved upward by a distance good for sufficiently reducing the internal pressure of the liquid tank 1, from which all the residual liquid has been drawn out. When the internal pressure of the liquid tank 1 is reduced to a sufficient extent, the piston 31 is stopped and the atmosphere exposure valve 35 is opened. As a result, the atmosphere pressure is applied to the liquid in the inside of the liquid supply tank 33 to produce a pressure difference between there and the inside of the liquid tank 1 whose internal pressure has been reduced so that the liquid tank 1 is filled with liquid that comes from the liquid supply tank 33 by way of the liquid incoming/outgoing pipe 36 and the liquid outlet port 4. When the operation of filling the liquid tank 1 with liquid is over, the cap 38 is removed from the atmosphere exposure port 2 of the liquid tank 1 and the liquid tank 1 is taken out.

The piston 31 may be driven either by hand or by power typically by a motor. Though the operator is occupied by the refilling operation in the case where the piston is driven by hand, the refilling operation of the invention still has the beneficial merit that the operator is not required to have a specific skill and the refilling operation can be completed within much shorter time if compared with the conventional method where the pressure for refilling liquid is controlled manually.

As described above, according to the invention, with a liquid container of the type having a porous liquid absorbent member arranged in the inside and adapted to hold liquid under negative pressure generated in the inside and communicating to a liquid ejection head so as to supply liquid from the inside to the liquid ejection head by way of a liquid outlet port, the liquid remaining in the liquid container is drawn out by way of the liquid outlet port, the inner pressure of the liquid container is reduced by way of the liquid outlet port and liquid is refilled from the inside of a liquid supply tank into the liquid container by way of the liquid outlet port. With this arrangement, it is now possible to accurately refill the liquid container regardless of the amount of liquid remaining in the liquid container without requiring any complex control procedure and complex device. Additionally, the operator is not required to have a specific skill for the liquid refilling operation nor occupied by the operation for a long period of time. Still additionally, because only the liquid outlet port is used for drawing out liquid from and filling liquid into the liquid container in the liquid refilling operation, any possible degradation of the performance of the liquid container due to the provision of a liquid flow path not directed to the liquid outlet port is effectively avoided.

What is claimed is:

1. A liquid filling method for filling liquid into a liquid container communicating to a liquid ejection head so as to supply liquid from the inside to the liquid ejection head by way of a liquid outlet port, said method comprising:

a step of drawing out liquid remaining in said liquid container by way of the liquid outlet port;

a step of reducing the inner pressure of the evacuated liquid container by way of the liquid outlet port; and a step of filling liquid from the inside of a liquid supply tank into the liquid container by way of the liquid outlet port.

2. A method according to claim 1, wherein the liquid drawn out from the liquid container is fed back into the liquid supply tank.

3. A method according to claim 1 or 2, wherein the time to be used for the step of drawing out the liquid remaining in the liquid container is determined on the basis of the relationship between the maximum liquid containing capacity of the liquid container and the means to be used for drawing out liquid and the liquid remaining in the liquid container is drawn out in a determined constant operation time regardless of the amount of liquid remaining in the liquid container.

4. A method according to claim 1 or 2, wherein the time to be used for the step of reducing the internal pressure of the liquid container is determined on the basis of the relationship between the maximum volume of gas containable in the inside of the totally evacuated liquid container and the means to be used for reducing the internal pressure of the liquid container and the internal pressure of the liquid container is reduced in a predetermined constant operation time.

5. A liquid filling apparatus for filling liquid into a liquid container communicating to a liquid ejection head so as to supply liquid from the inside to the liquid ejection head by way of a liquid outlet port, said apparatus comprising:

a liquid drawing out means for drawing out liquid remaining in the liquid container by way of the liquid outlet port;

a pressure reducing means for reducing the inner pressure of the evacuated liquid container by way of the liquid outlet port;

a filling means for filling liquid from the inside of said liquid supply tank into the liquid container by way of the liquid outlet port.

6. An apparatus according to claim 5, further comprising a liquid feeding back means for feeding the liquid drawn out from the liquid container by said liquid drawing out means back into said liquid supply tank.

7. An apparatus according to claim 5 or 6, further comprising a collection tank for temporarily holding the liquid drawn out from the liquid container by said liquid drawing out means.

8. An apparatus according to claim 7, wherein the capacity of said collection tank is substantially equal to the capacity of a liquid container that is largest among liquid containers expected to be refilled with liquid by said liquid filling apparatus.

9. An apparatus according to claim 7, wherein the bottom surface of said collection tank is located above said liquid supply tank.

10. An apparatus according to claim 5 or 6, wherein said liquid drawing out means is provided with a suction pump or piston cylinder mechanism and the drive time of said suction pump or piston cylinder mechanism is determined on the basis of the relationship between the performance of said suction pump or piston cylinder mechanism and the maximum liquid containing capacity of the liquid container so as to drive said suction pump or piston cylinder mechanism and draw out the liquid remaining in the liquid container for a determined constant operation time regardless of the amount of liquid remaining in the liquid container.

11. An apparatus according to claim 5 or 6, wherein said pressure reducing means is provided with a suction pump or piston cylinder mechanism and the drive time of said pressure reducing means is determined on the basis of the relationship between the performance of said suction pump or piston cylinder mechanism and the maximum volume of gas containable in the inside of the totally evacuated liquid container so as to drive said suction pump or piston cylinder mechanism and reduce the internal pressure of the liquid container for a determined constant operation time.

12. An apparatus according to claim 5, wherein said liquid drawing out means and said pressure reducing means are commonly provided with a suction pump or piston cylinder mechanism.

* * * * *